United States Patent [19]

Fasano

[11] Patent Number: 5,053,736

[45] Date of Patent: Oct. 1, 1991

[54] MOLDED SPLIT CASE ELECTROMAGNETIC CIRCUIT BREAKER ASSEMBLY

[75] Inventor: Michael A. Fasano, Watertown, Conn.

[73] Assignee: Carlingswitch, Inc., Plainville, Conn.

[21] Appl. No.: 553,870

[22] Filed: Jul. 16, 1990

Related U.S. Application Data

[62] Division of Ser. No. 240,269, Sep. 2, 1988, abandoned.

[51] Int. Cl.[5] ..... H01H 7/02

[52] U.S. Cl. ..... 335/62; 335/59; 335/177

[58] Field of Search ..... 335/177-179, 335/6, 14, 20, 59-64

[56] References Cited

U.S. PATENT DOCUMENTS 3,566,320 2/1971 Bakes ..... 335/177

*Primary Examiner*—Gerald P. Tolin
*Assistant Examiner*—Lincoln Donovan
*Attorney, Agent, or Firm*—McCormick, Paulding & Huber

[57] ABSTRACT

An electromagnetic circuit breaker has a housing that includes a separately defined arc chamber in which the moving contact travels as the breaker is tripped, and the chamber has a divergent shape to facilitate exhausting the hot gases from the arc chamber through a metal screen and through vent openings in the end wall of the breaker housing. The housing is made in two half sections that are held together by rivets and the location of one of these rivets is isolated from the fixed contact at the lower end of the arc chamber by the unique arc chamber configuration. The lower wall of the circuit breaker housing is adapted to receive either a molded switch subassembly or to receive a terminal strip that is held in place by the primary terminals of the breaker and is adapted also to support auxiliary terminals that operate a shunt coil. The shunt coil itself is fitted on a bobbin that is selectively mounted on the bobbin that contains the primary electromagnetic coil for the breaker. Thus, a single circuit breaker housing design configuration is adapted for use in assembling a number of differently configured electromagnetic circuit breakers.

14 Claims, 3 Drawing Sheets

MOLDED SPLIT CASE ELECTROMAGNETIC CIRCUIT BREAKER ASSEMBLY

This is a divisional of co-pending application Ser. No. 240,269 filed on Sept. 2, 1988, abandoned Nov. 11, 1990.

BACKGROUND OF THE INVENTION

This invention relates generally to electromagnetic circuit breakers of the type having a housing made in two half sections, each of which is of molded plastic dielectric material. The half sections are held together by fasteners so as to support the circuit breaker mechanism and terminal components between these half sections.

Electromagnetic circuit breakers are designed to provide a load current and voltage through an electromagnetic coil that surrounds a delay tube in which a plunger or core is adapted to be drawn towards a pole piece at the end of the delay tube by reason of the magnetic flux created in a frame and armature. The frame is mounted between the circuit breaker half sections to support both the electromagnetic coil, on a bobbin or the like, and to also support a circuit breaker mechanism that is adapted to be tripped by the armature. The armature engages a sear to open the electrical contacts provided in an arc chamber also defined in the housing. The arc chamber is vented to release the gasses generated by the contacts on opening to avoid the buildup of excessive heat and pressure within the circuit breaker housing. U.S. Pat. No. 3,997,746 illustrates such an arc chamber and one object of the present invention is to provide for an improved arc chamber configuration with improved dielectric fortification between the terminal associated with the fixed contact in the bottom of the circuit breaker housing and an adjacent rivet provided to hold the housing half sections in assembled relationship.

In order to provide for remote and/or automatic tripping of the breaker a relay coil is provided in a separate electric control circuit. The circuit to be protected (the load circuit) is conventionally configured to achieve electromagnetic operation of the breaker in response to an overcurrent condition. The control circuit provides for selective tripping of the breaker. Thus, another object of the sent invention is to provide for an improved electromagnetic coil configuration, and more particularly for the bobbin that supports the coil, such that the breaker can be assembled with or without such a relay coil, and so that one design is possible for the frame, delay tube, pole piece and solenoid core or plunger. These components are provided in a single design circuit breaker assembly that may be fitted with a relay coil that allows the contacts to be tripped remotely.

Molded case electromagnetic split case circuit breakers must also accommodate a variety of stud or terminal configurations. For example, with a relay coil provided in the breaker as referred to above, additional or auxiliary terminals are required to provide the relay coil with the voltage necessary to pull the armature in and thereby to trip the breaker. Auxiliary terminals are conveniently provided in an optionally used terminal strip that may or not be provided in the molded case circuit breaker depending upon the design requirements of a particular installation. Alternatively, an auxiliary switch case is designed to fit an opening provided for this purpose in the bottom wall of the split case electromagnetic circuit breaker housing.

SUMMARY OF THE INVENTION

In accordance with the present invention the electromagnetic circuit breaker housing comprises front and rear half sections held together by metal fasteners or the like extending through aligned openings in these half sections. A circuit breaker mechanism is provided in the housing and includes a collapsible toggle mechanically coupled to an armature that is pivotally mounted on a frame also held in the housing half sections. When the armature is tripped a sear collapses the toggle mechanism causing a movable contact lever to move its contact upwardly away from a fixed contact in an arc chamber. The arc chamber includes laterally spaced front and rear insulated boards provided in parallel relationship to one another. These boards define slots oriented transversely to the path of movement for the movable contact and support metal grid elements of generally U-shaped. The arc chamber further includes a top wall and an inner wall defined by a bent sheet of insulated board material that defines a shape suggestive of the numeral 7. The inner wall has a lower end portion provided in aligned slots of the housing half sections so as to be located between one of the fasteners or rivets and the fixed contact structure.

The electromagnetic portion of the breaker includes a bobbin surrounding the delay tube, the latter being attached to the frame and carrying the pole piece at the end opposite such attachment point. This bobbin has flanges defining an annular space for housing the primary electromagnetic coil that will move the plunger toward the pole piece in response to an over current-/over voltage condition. An auxiliary annular space is defined by the bobbin around the pole piece itself and an auxiliary bobbin having flanges of its own is optionally provided in this space to house an auxiliary or relay coil for selectively tripping the breaker independently of the current and/or voltage in the electromagnetic coil.

Terminal means are provided in the breaker referred to above either in the form of side accessible connecting points, or in the form of posts or studs provided in the bottom wall of the breaker in which case these studs or terminals are provided in, and help to support, a terminal strip coextensive with the bottom wall of the housing and having integrally defined locating studs adapted to fit into locating holes defined for this purpose in the bottom wall of the housing. An auxiliary switch may optionally be provided in an opening of the housing wall when the terminal strip and studs are not provided for. However, the auxiliary studs are particularly suited for electrically energizing the relay coil when the breaker is to be tripped remotely through a control circuit.

DETAILED DESCRIPTION OF PREFERRED EMBODIMENTS

Figure 1:
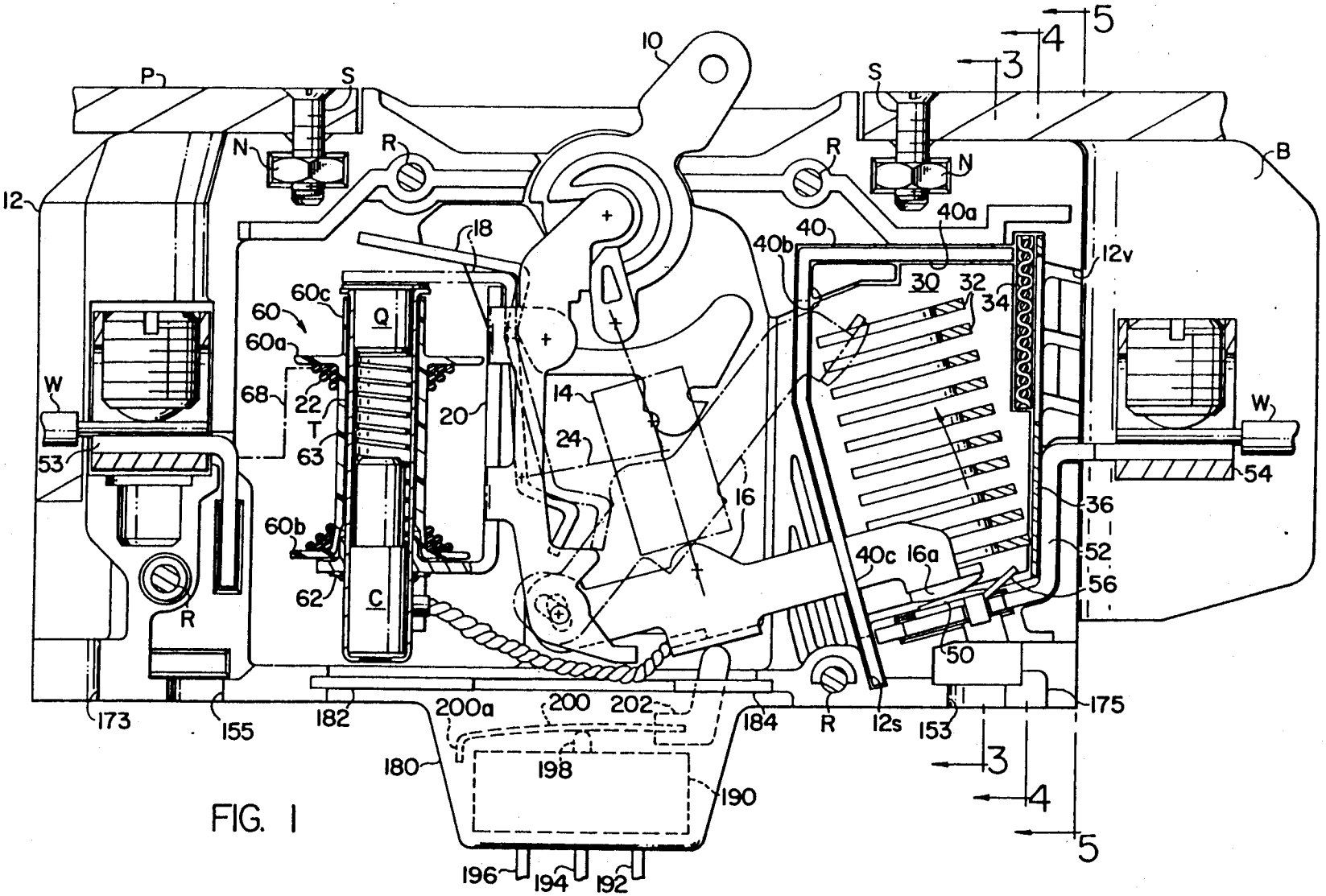
FIG. 1 is an elevational view of one half section of the circuit breaker housing showing the various components of a typical circuit breaker mechanism and electromagnetic frame assembly provided therein. The contact lever is shown closed in solid lines and open in broken lines.

Turning now to the drawings in more detail, FIG. 1 shows an electromagnetic circuit breaker incorporating certain features of the present invention and mounted in a panel P by means of two screws S,S so that a toggle or handle 10 can be used to reset the breaker after it has been tripped.

The circuit breaker housing comprises two molded plastic half sections, only one of which is shown as the rear section 12 in FIG. 1. The front half section 13 has been omitted for clarity from this view. These half sections are riveted to one another as indicated generally by the rivets R,R. The screws S,S are provided in captive nuts N,N provided between these half sections to support the breaker in the panel in accordance with conventional practice. These housing half sections define an internal cavity where the circuit breaker mechanism is mounted. This mechanism comprises a collapsible toggle link mechanism 14 that is used to couple the handle 10 to a contact lever 16, shown closed in full lines and open in broken lines. This collapsible toggle mechanism may be of conventional configuration such as that depicted in issued U.S. Pat. No. 4,347,488. The circuit breaker operation provides for collapsing the toggle mechanism 14 through movement of an armature 18 from the solid line position shown to the broken line position as a result of magnetic forces induced in the frame 20 and in the movable magnetic solenoid core C and in the pole piece Q. Magnetic flux created as a result of an over current/over voltage in the coil 22 pulls the core C upwardly in the delay tube T with the result that pole piece Q pulls armature 18 downwardly toward it causing the other end of the armature 18 to act through a mechanical sear (not shown) but indicated schematically at 24 so as to collapse the link 14 and allow the spring loaded contact lever 16 to move from its solid line position to its broken line position opening the contacts 16*a* and 50.

The movable contact 16*a* on contact lever 16 moves upwardly on opening to define a path of movement indicated generally by the arrow and associated phantom line in FIG. 1. The contact 16*a* and lever 16 are shown in closed position in full lines and in open position in broken lines. As the contact 16*a* on the movable contact lever 16 follows this path of movement during an overload condition, it is important to prevent the resulting electric arc produced from reaching the mounting panel P and/or other metal components of the breaker mechanism itself. Consequently, an arc chamber is provided for the movable contact 16*a* with the following characteristics. In addition to the dielectric plastic half sections for the molded circuit breaker case laterally spaced front and rear insulated boards 30 of fish paper or the like are provided, as indicated generally at 30 in FIG. 1, and these boards 30 are slotted to receive U-shaped metal grid elements that are preferably made from steel. These grid elements 32,32 serve to extinguish the arc from the opening contacts and to dissipate the heat generated on opening at high overload conditions. The space between these grid elements provides openings for the discharge of the gases produced so that the pressure produced can be dissipated through a metal mesh screen indicated generally at 34.

Figure 4:
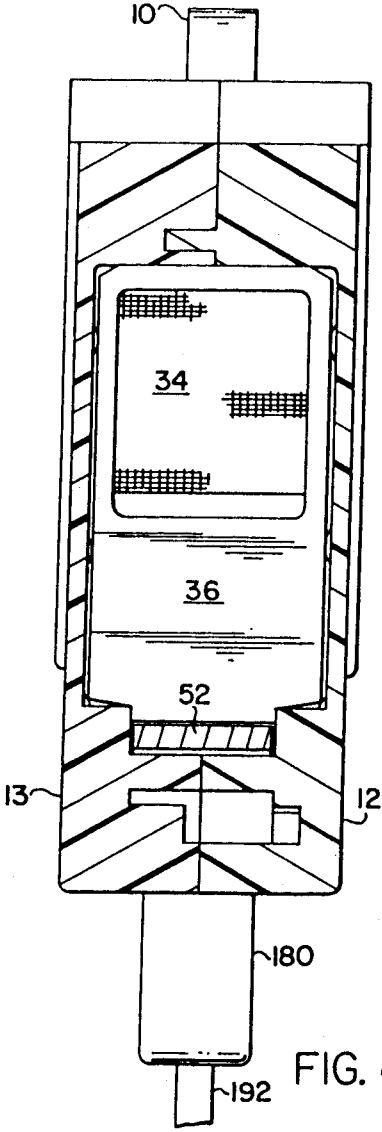
FIG. 4 is a vertical sectional view taken generally along the line 4,4 of FIG. 1.

The screen 34 is supported by these parallel insulating boards, 30,30 in much the same manner as these boards 30 support the U-shaped grid elements 32,32. The arc chamber further includes an outer end wall 36 and the outer end wall defines an opening for the screen 34 as best shown in FIG. 4.

Figure 3:
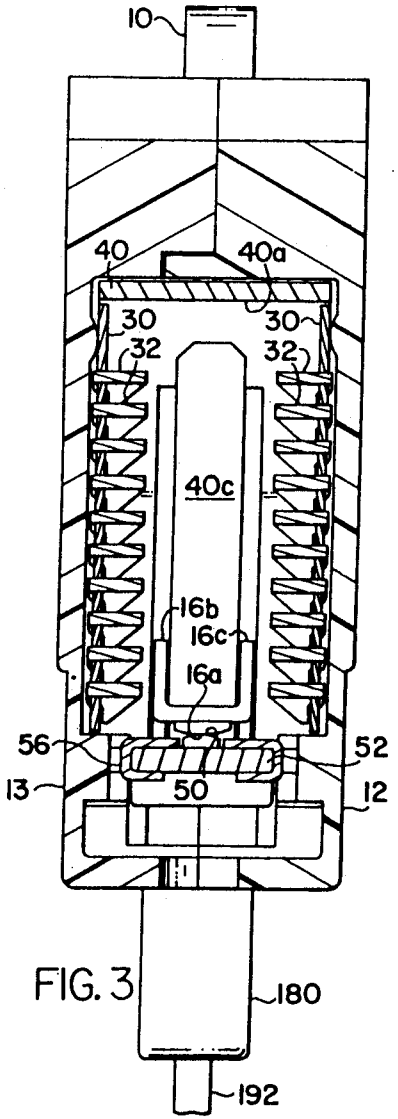
FIG. 3 is a sectional view taken generally along the line 3,3 of FIG. 1 illustrating the arc chamber associated with the movable contact of the circuit breaker mechanism of FIGS. 1 and 2.

The arc chamber further includes an integrally formed top and inner end wall defined by a bent sheet of insulated board material. The inner end and top walls have a shape suggestive of the numeral 7. The top wall is indicated generally at 40*a* and the inner end wall at 40*b*. The latter includes an inclined lower end portion 40*c* that is slotted to receive the two parallel arms 16*b* and 16*c* of the movable contact lever 16 as best shown in FIG. 3. The lower end portion of the inner end wall is provided in aligned slots 12*s* of the housing bottom wall and is provided between the fixed contact 50 and adjacent rivet R so as to increase the dielectric strength of the resulting breaker in the area of the arc chamber.

Figure 5:
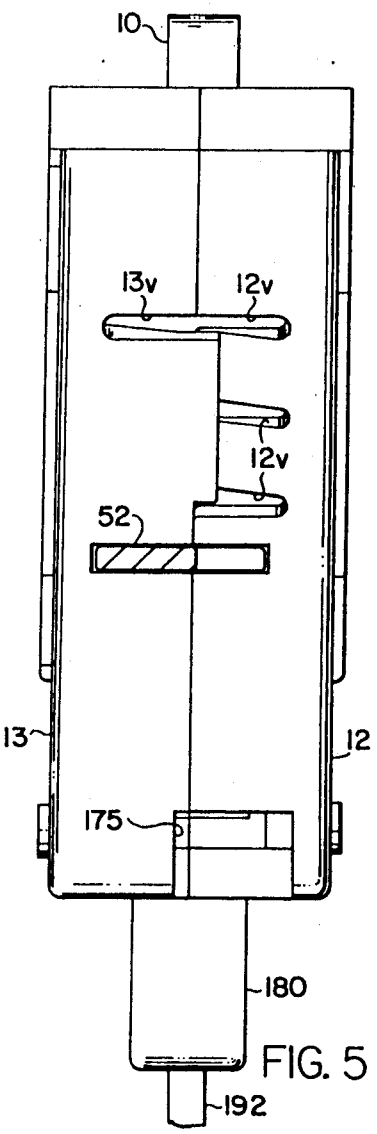
FIG. 5 is a vertical sectional view taken generally along the line 5,5 of FIG. 1.

The fixed contact 50 is provided on a bent terminal bar 52 that supports a conventionally configured connector 54 so that a wire W can be secured to the connector 54 to provide an electrical connection between the wire W and the fixed contact 50 on the terminal bar 52. The terminal bar 52 is preferably fitted with a steel shoe 56 which shoe includes an upturned end portion for deflecting the hot gases away from the terminal bar 52 and directing these gases upwardly in the arc chamber where they can be dissipated and ultimately discharged through the screen 34 referred to previously. The shoe 56 also draws the arc off of the stationary contract and onto its cooler surface. In essence this shoe 56 also acts as an arcing horn on the stationary contact terminal. Slots 12*v* and 13*v* are provided in the end wall of the circuit breaker housing half sections 12 and 13 so as to provide an exit for these gases after they have been so dissipated as best shown in FIG. 5.

The inner wall of the arc chamber and more particularly the lower portion 40*c* thereof is canted so that the lower end portion is received in the slots 12*s* defined by the housing half sections. This lower portion 40*c* is oriented generally perpendicular to the arcing horns or grid elements 32 or parallel to the path of contact 16*a* as referred to previously. The fixed contact and more particularly the lower end portion of the terminal bar 52 and the shoe 56 define the lower portion of the arc chamber and it is important to note that the lower portion 40*c* of the inner wall cooperates with the outer wall 36 to define an upwardly divergent lower region of this arc chamber in order to dissipate the gasses and plasma generated by the breaker's opening contacts in a generally upward direction toward the metal screen 34 and the vents 12*v* and 13*v* referred to previously. Both the inner wall 40 and the outer wall 36 of the arc chamber are supported in slots provided for this purpose in the circuit breaker housing half sections 12 and 13 and it should be noted that the upper portions of both the inner and outer arc chamber walls are so spaced apart as to provide an arc chamber upper portion of greater volume than the lower arc chamber portion defined by the lower portions thereof. This geometry provides improved dielectric strength for the breaker as between the terminal strip 52 and fixed contact 50 and the rivet R.

Turning next to a discussion of the electromagnetic structure that serves to trip the armature 18, FIG. 1 shows the armature 18 in two positions; one corresponding to the contact closed condition (that is the solid line position for armature 18) and the other for the armature tripped condition (shown in broken lines corresponding to the contacts open position also illustrated in broken lines in FIG. 1).

This electromagnetic structure includes the steel frame 20 that pivotally supports the armature 18 and that also supports the contact lever 16 and the handle 10 in accordance with conventional circuit breaker manufacturing techniques. The frame 20 also supports delay tube T by means of an annular fastener 62 and the delay tube is provided with a pole piece Q at its upper end so that the electromagnetic coil 22 surrounding the delay tube T is adapted to pull the plunger or core C upwardly against the downward force of a return spring 63 provided between the pole piece Q and a shoulder of the plunger or core C. The delay tube T may be filled with a damping fluid such as oil in order to reduce the speed of movement for the plunger or core C and hence to increase the time required for tripping of the armature 18. The coil 22 is supported between flanges 60*a* and 60*b* of a plastic molded bobbin 60 and it is an important feature of the present invention that the bobbin 60 also includes an upwardly extending collar portion 60*c* that surrounds the pole piece Q and that serves to space the upper end of coil 22 from the end of the pole piece Q that is adapted to being engaged by the armature 18.

Figure 2:
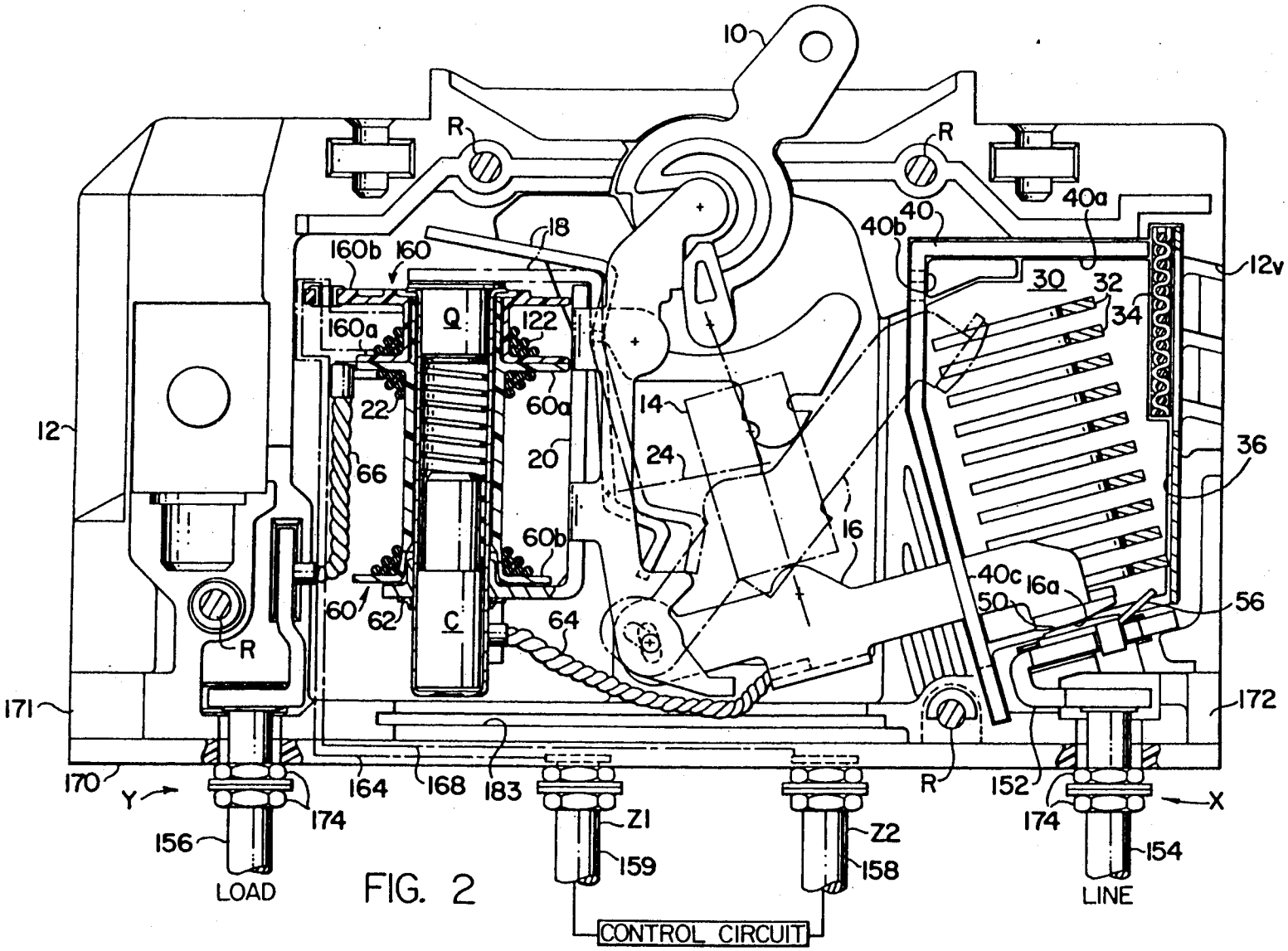
FIG. 2 is a view similar to FIG. 1, but illustrating a relay coil provided above the electromagnetic coil in the electromagnetic relay portion of the breaker, and also illustrating an alternative terminal defining means to include auxiliary terminals for such a coil.

Turning now to a more detailed description of FIG. 2, it will be noted that the circuit breaker housing half sections 12 and 13 are identical to those provided in the circuit breaker assembly of FIG. 1 except for the barrier B that isolates the terminal 54 from that of an adjacent circuit breaker terminal (not shown). This barrier can be formed or not formed in the process of molding the breaker half sections simply by removing or inserting a mold insert (not shown but shaped to fill the mold cavity that forms this barrier B). Furthermore, the arc chamber construction is identical to that of FIG. 1 save only the actual configuration of the terminal bar 152 provided for the fixed contact 50. Where the FIG. 1 circuit breaker assembly is designed to accommodate connecting wires W,W at the sides of the housing the FIG. 2 circuit breaker assembly is designed to accommodate connections at the bottom of the circuit breaker housing, as indicated generally at X and Y in FIG. 2. However, the electrical connections to the coil 22 in FIG. 2 are identical to the connections provided for in FIG. 1. That is, the movable contact lever 16 is connected by means of a braided wire 64 to one end of the coil 22 and the other end of the coil 22 is connected by means of braided wire 66 to the opposite terminal Y in FIG. 2. FIG. 1 shows coil 22 connected to the terminal bar 53 by a wire 68.

Thus, the breaker in FIG. 2 operates in substantially the same manner as that described above with reference to FIG. 1 in that the armature 18 is pulled or tripped by electromagnetic flux created between pole piece Q, core C and frame 20 as a result of over current/over voltage conditions created in the coil 22. FIG. 2 further includes a relay coil 122 provided on a smaller auxiliary plastic bobbin 160. Opposed flanges 160*a* and 160*b* are provided in the bobbin 160. A center opening in the auxiliary bobbi . permits it to be received on the primary bobbin 60. The collar portion 60*c* of the primary bobbin 60 is designed to so receive auxiliary bobbin 160 in order to permit installation of the relay coil 122 on any circuit breaker equipped with a bobbin 60 such as that shown and described above with reference to FIG. 1.

The relay coil 122 is provided in a separate control circuit by leads 164 and 168 associated with the ends of the wire in coil 122. These leads 164 and 168 are each connected to associated terminals Z1 and Z2 so that the relay coil 122 can be used to remotely trip the breaker mechanism while the primary coil 22 carries the normal load current that is not enough to produce a magnetic flux situation in the frame, the pole piece and the plunger C to achieve tripping of the armature 18.

As a result of the above-described bobbin configuration, it will be apparent that a single design circuit breaker housing assembly can be provided to accommodate a relay coil in one version of the breaker without the necessity for substituting bobbins, and in the straightforward assembly of FIG. 1 the pole piece Q preferably has its lower face located in approximately the same plane as that defined by the adjacent flanges 60*a* and 160*a* of the primary and auxiliary bobbins or spools.

Turning next to a more detailed description of the terminal configurations provided for in the circuit breakers of FIGS. 1 and 2, it will be recalled that the wires W,W connected to the terminals 52 and 53 of the circuit breaker housing are received at the ends of the housing and more particularly are received in connectors 54 provided for this purpose. This geometry may be required where the backspace behind the panel P is limited, or where the type of connectors 54 are required to accommodate larger size wire W.

In FIG. 2, on the other hand, the terminals X and Y associated with the fixed contact and the electromagnetic coil 22 respectively are in the form of studs that carry nuts and washers to facilitate securing conductive leads or wires (not shown) at the bottom of the circuit breaker housing. Obviously, the studs 154 and 156 could be provided instead of the terminal bars 52 and 53 in the circuit breaker housing assembly of the FIG. 1 breaker. As shown in FIG. 2, additional studs 158 and 159 are provided in the circuit breaker housing assembly of FIG. 2. As mentioned previously, the additional two auxiliary studs 158 and 159 are available for providing electrical connections to the relay coil 122 in the FIG. 2 breaker.

In further accordance with the present invention a molded terminal strip 170 is provided on the bottom wall of the circuit breaker housing to support the auxiliary terminals 158 and 159. This molded terminal strip 170 includes openings for receiving and self-supporting these auxiliary terminals 158 and 159, and this molded strip 170 is held in place by the studs 154 and 156 associated with the fixed contact and primary coil 22 respectively. The studs 154 and 156 have upper ends that define downwardly facing flanges that engage abutment surfaces provided around the openings 153 and 155 to permit these studs 154 and 156 to be secured in place by the nuts 174, 174. The molded terminal strip 170 has upstanding integrally defined locating studs 171 and 172 adjacent each end, which studs are adapted to be received in complementary shaped openings 173 and 175 respectively defined for this purpose in the molded circuit breaker half sections (FIG. 1 shows these openings and FIG. 2 shows the locating studs provided in the openings).

With reference to the circuit breaker half sections and more particularly with reference to the bottom wall defined thereby, FIG. 1 shows a molded switch case 180 provided in an opening defined centrally of the bottom wall of the switch case half sections 12 and 13. This molded switch case 180 includes flanges 182 and 184 that are received in slots indicated generally at 183 in FIG. 2, so that a conventional limit switch 190 can be provided in the molded switch case 180 as suggested in FIG. 1. The limit switch 190 is of conventional configuration having three terminals 192, 194 and 196 that permit remote indication of the circuit breaker's condition through a mechanism provided between the plunger 198 of the limit switch 190 and the underside of the movable contact arm or lever 16 of the circuit breaker mechanism. A cantilever spring 200 is provided in the molded switch case 180 and, more particularly, has its fixed end portion 200*a* provided in a slot defined by the molded switch case 180 so that the free end of the cantilever spring 200 can itself support a molded plastic button 202 that is secured to the free end of the spring 200 and is adapted to be engaged by the underside of the movable contact lever 16 of the circuit breaker mechanism. Thus, as the contact lever 16 moves from the solid line to the broken line position illustrated in FIG. 1, the resilient spring 200 will cause the button 202 to follow the lever 16 and allow the plunger 198 of the limit switch 190 to move upwardly so as to enable an indicating circuit (not shown) for remote indication of the circuit breaker's condition.

I claim:

1. A circuit breaker comprising a housing, a frame in the housing, fixed and movable contacts in the housing, electromagnetic means electrically coupled to said fixed and movable contacts, said electromagnetic means including armature means movably mounted on said frame, a pole piece supported in fixed relationship to said frame and having one end adapted to be engaged by said armature and an opposite end spaced from said one end, a plunger tube for so supporting said pole piece, a plunger movably mounted in said tube, a primary bobbin surrounding said tube, said primary bobbin having flanges defining an annular space for housing a primary coil for magnetically moving said plunger toward said pole piece one end in response to an over current/over voltage condition in the coil winding, an auxiliary annular space defined by said primary bobbin around said pole piece, and an auxiliary bobbin having flanges adjacent its opposite ends, said auxiliary bobbin being selectively received on said primary bobbin to occupy said auxiliary annular space, and an auxiliary coil provided on said auxiliary bobbin, between said flanges thereof, said auxiliary bobbin having one flange located adjacent a flange on said primary bobbin, and said adjacent primary and auxiliary bobbin flanges oriented in substantially the same plane as that of said pole piece opposite end.

2. The combination of claim 1 wherein said plunger tube contains a fluid to dampen movement of said plunger due to over voltage, over current conditions in said coil windings, said pole piece having an inner end engageable by said plunger, and said pole piece inner end being located in generally the same plane as that defined by said auxiliary bobbin one flange and said adjacent primary coil bobbin.

3. A circuit breaker comprising a housing, a frame in the housing, fixed and movable contacts in the housing, electromagnetic means electrically coupled to said fixed and movable contacts, said electromagnetic means including armature means movably mounted on said frame, a pole piece supported in fixed relationship to said frame and adapted to be engaged by said armature, a plunger tube for so supporting said pole piece, a plunger movably mounted in said tube, a bobbin surrounding said tube, said bobbin having flanges defining an annular space for housing a coil for magnetically moving said plunger toward said pole piece in response to an over current/over voltage condition in the coil winding, an auxiliary annular space defined by said bobbin around said pole piece, and an auxiliary bobbin having flanges adjacent its opposite ends, said auxiliary bobbin being selectively received on said first mentioned bobbin to occupy said auxiliary annular space, and an auxiliary coil provided on said auxiliary bobbin, generally between said flanges thereof, said auxiliary bobbin having one flange located adjacent a flange on said first mentioned bobbin, said housing having two half sections, fastener means extending through aligned openings in said housing half sections, one of said fastener means provided adjacent said fixed contact, a circuit breaker mechanism including a collapsible toggle mechanically coupled to said armature means for moving said movable contact from a closed to an open position in response to said over current/over voltage condition in said coil winding, means defining an arc chamber in said housing and including said fixed contact as one boundary thereof, said arc chamber having laterally spaced front and rear insulated boards provided in parallel relationship to the path of movement of said movable contact, said boards defining grid support slots oriented transversely to said path of said movable contact, metal grid elements in said slots, said arc chamber defining means further including an end wall adjacent one end of said housing, said end wall of said arc chamber including a metal screen supported by said front and rear boards, said housing half sections having slots to vent said arc chamber through said screen, said arc chamber including a top wall and an inner wall defined by a bent sheet of insulated board material said inner wall of said arc chamber having a shape suggestive of the numeral seven (7) said inner arc chamber wall having a lower end portion provided in aligned slots of said housing half sections between said one fastener means and said fixed contact to increase the dielectric strength of the resulting breaker.

4. The combination of claim 3 wherein said plunger tube contains a fluid to dampen movement of said plunger due to over voltage, over current conditions in said coil windings, said pole piece having an inner end engageable by said plunger, and said pole piece inner end being located in generally the same plane as that defined by said auxiliary bobbin one flange and said adjacent primary coil bobbin.

5. The combination of claim 3 wherein said inner wall of said arc chamber has a lower portion extending upwardly from said lower end portion and oriented generally perpendicular to said grid slots said fixed contact defining the lower boundary of the arc chamber, and a metal shoe for said fixed contact, said shoe having a shape and size somewhat smaller than that of said metal grid elements.

6. The combination of claim 5 wherein said outer end wall of said arc chamber further includes a lower portion opposite said lower portion of said inner wall, said lower portions being upwardly divergent and said outer end wall having an upper portion defined by said metal screen.

7. The combination of claim 6 wherein said inner and outer arc chamber walls are supported in shallow slots defined by said housing half sections, said grid elements supporting said front and rear boards in said laterally spaced parallel relationship.

8. The combination of claim 7 wherein said inner arc chamber wall has an upper portion opposite said outer end wall upper portion, said upper portions being spaced apart to provide an arc chamber upper portion of greater volume than the lower arc chamber portion defined by said lower portions of said inner and outer walls.

9. The combination of claim 8 wherein said movable contact lever has a pivoted end supported in said housing and a free end defining said movable contact, an intermediate portion of said movable contact lever comprising two parallel plates movable in two parallel slots defined by said inner arc chamber wall lower portion, said plates oriented generally perpendicular to said lower portion of said inner arc chamber wall.

10. A circuit breaker housing having front and rear half sections, each section having a top, a bottom, and opposed end walls to define a cavity, fixed and movable contacts in said cavity, electromagnetic means electrically coupled to said fixed and movable contacts and including an armature and coil, a collapsible toggle mechanism coupled to said armature to move said movable contact in response to an over current condition in a circuit that includes said fixed and movable contacts, first terminal means electrically connected to said fixed contact and including a portion accessible to one end of said housing, second terminal means electrically connected to said electromagnetic coil and including a portion accessible to the opposite end of said housing, a molded terminal strip coextensive with the bottom wall of said housing and having integrally defined locating studs adapted to fit into locating holes defined in said housing bottom wall, and said bottom wall and terminal strip having aligned openings to receive auxiliary terminals.

11. The combination of claim 10 wherein said bottom wall defines a switch opening for receiving an auxiliary switch, said opening being covered by said terminal strip when the latter is provided as aforesaid.

12. The combination of claim 11 further characterized by an auxiliary switch having a case, said switch case having flanges received in slots defined by the half sections that define said bottom wall whereby said auxiliary switch can be provided in place of said terminal strip.

13. The combination of claim 12 wherein said auxiliary switch case defines a cavity for a limit switch, a limit switch in said cavity and having terminals projecting outwardly of said case and a plunger within said case cavity for activating said limit switch, and a plunger engageable lever with one end supported in said case, said lever having a free end portion, biasing means urging said free lever end portion into engagement with said movable contact moving mechanism.

14. The combination of claim 10 further characterized by a frame, said armature movably mounted on said frame, a pole piece supported in fixed relationship to said frame for engagement by said armature, a plunger tube for so supporting said pole piece, a plunger movable in said tube, a bobbin surrounding said tube, said bobbin having flanges defining an annular space for said coil, said second terminal means electrically connected to said coil and said coil also electrically connected to said movable contact, an auxiliary annular space defined by said bobbin around said pole piece, and an auxiliary bobbin having flanges adjacent its opposite ends, said auxiliary bobbin being selectively received on said bobbin to occupy said auxiliary annular space, an auxiliary coil provided on said auxiliary bobbin between said opposite flanges, one said auxiliary bobbin flange located adjacent a flange of said bobbin, said auxiliary terminals electrically connected to said auxiliary coil.

* * * * *